US007283015B1

(12) United States Patent
Rockenbauch

(10) Patent No.: US 7,283,015 B1
(45) Date of Patent: Oct. 16, 2007

(54) DEVICE FOR IMPEDANCE MATCHING RADIO FREQUENCY OPEN WIRE TRANSMISSION LINES

(75) Inventor: Craig A. Rockenbauch, Severna Park, MD (US)

(73) Assignee: The United States of America as Represented by the National Security Agency, Washington, DC (US)

( * ) Notice: Subject to any disclaimer, the term of this patent is extended or adjusted under 35 U.S.C. 154(b) by 82 days.

(21) Appl. No.: 11/233,217

(22) Filed: Sep. 22, 2005

Related U.S. Application Data

(63) Continuation-in-part of application No. 11/152,728, filed on Jun. 14, 2005, now abandoned.

(51) Int. Cl.
*H01P 5/04* (2006.01)

(52) U.S. Cl. ..... 333/33; 333/161; 333/4

(58) Field of Classification Search ..... 333/33, 333/246, 161, 4

See application file for complete search history.

(56) References Cited

U.S. PATENT DOCUMENTS 3,139,597 A * 6/1964 French et al. ..... 333/161
3,405,375 A * 10/1968 Kelley ..... 333/161
4,754,239 A 6/1988 Sedivec
4,785,266 A 11/1988 Newham et al.
6,075,424 A * 6/2000 Hampel et al. ..... 333/161
6,441,700 B2 * 8/2002 Xu ..... 333/161
6,653,911 B2 11/2003 Estes et al.
6,717,965 B2 4/2004 Hopkins, II et al.

OTHER PUBLICATIONS

George L. Ragan ed.; Microwave Transmission Circuits; 1964; pp. 456-481; Boston Technical Publishers, Inc. USA.
Herbert J. Reich, ed.; Very High-Frequency Techniques; 1947; pp. 794-795; McGraw-Hill Book Company, Inc USA.
Chuck Hutchinson ed., 2001 ARRL Handbook for Radio Amatuers; pp. 19.10-19.17 and 20.50-20.51; American Radio Relay League USA.

* cited by examiner

*Primary Examiner*—Benny Lee
(74) *Attorney, Agent, or Firm*—Eric Froehlich

(57) ABSTRACT

An impedance matching device comprises a dielectric material having a ground plane affixed to one surface, a microstripline conductor disposed on an opposite surface, and a movable dielectric plate. The movable dielectric plate has a higher dielectric constant than the dielectric material, a user-selectable shape, and a conductive coating on the top surface. The bottom surface of the movable dielectric plate engages a portion of the microstripline conductor, and is movable transversely to the microstripline conductor to increase or decrease the impedance of the microstripline conductor and linearly to change the phase of the microstripline conductor.

1 Claim, 4 Drawing Sheets

DEVICE FOR IMPEDANCE MATCHING RADIO FREQUENCY OPEN WIRE TRANSMISSION LINES

CROSS REFERENCE TO RELATED APPLICATIONS

This application is a continuation-in-part of prior U.S. patent application Ser. No. 11/152,728, filed Jun. 14, 2005 now abandoned.

FIELD OF THE INVENTION

The present invention relates generally to radio frequency transmission lines, in particular to UHF and microwave frequencies, with variable lower impedance section.

BACKGROUND OF THE INVENTION

Impedance matching in radio frequency transmission lines may be accomplished in many different ways:

1. Lumped Elements—An L-C circuit using capacitors and inductors, is not usually seen above about 150 MHz.

2. Two and Three Stub Tuners—Two or three transmission line "stubs" are connected along the transmission line to be matched. The stubs each have a sliding short. The positions of the short are adjusted to have a matching effect. This has the disadvantages of being difficult to manufacture, has obscure interaction between the two or three adjustments, and having noisy sliding contacts.

3. Air line with dielectric slugs—A coaxial air line of nominal impedance (typically 50 Ohms) has two sliding slugs of dielectric material, sometimes with metal loading to increase the equivalent dielectric constant. Each slug is approximately a quarter wavelength long in the transmission line, producing a movable section of lower impedance (Z) line. When the two slugs are in contact, they form a half wavelength of low Z line, which has no transforming effect. A transforming effect is formed as the slugs move apart and the spaced pair is moved along the transmission line. This is relatively easy to adjust and has very low noise, because of having no physical sliding contacts. However, it is relatively hard to manufacture, and of relatively narrow band.

U.S. Pat. No. 4,754,239 discloses a waveguide to stripline transition assembly. Impedance matching is determined by adjusting a reflecting panel behind a tapered wedge. U.S. Pat. No. 4,754,239 is hereby incorporated by reference into the specification of the present invention.

U.S. Pat. No. 4,785,266 discloses a wedge shaped dielectric rod polarizer for microwave communication systems. The device imparts a phase shift on circularly polarized radiation at the wedge, so linearly polarized radiation exits the device. The device does not provide impedance matching along a transmission line. The present invention is not limited in this regard. U.S. Pat. No. 4,785,266 is hereby incorporated by reference into the specification of the present invention.

U.S. Pat. No. 6,653,911 discloses an integrated circuit apparatus for impedance matching. At least one stripline is sandwiched between two dielectric materials. The dielectric material is spaced a distance from a ground plane. A series of stripline segments are connected together, with the distance between the striplines and the ground plane selected for impedance matching. The thickness of the dielectric material varies, and is different than the thickness of the dielectric material in adjacent stripline sections resulting in a different distance between the stripline and the ground plane. The present invention is not limited in either regard. U.S. Pat. No. 6,653,911 is hereby incorporated by reference into the specification of the present invention.

U.S. Pat. No. 6,717,965 discloses a tapered interference filter for tuning a laser. A graded thin film is used as a channel selector. The device does not provide impedance matching along a transmission line. The present invention is not limited in this regard. U.S. Pat. No. 6,717,965 is hereby incorporated by reference into the specification of the present invention.

Known non-patent publications include:

Microwave Transmission Circuits, George L. Ragan ed., Boston Technical Publishers, Inc., 1964, pp.456-481;

Very High-Frequency Techniques, Herbert J. Reich ed., McGraw-Hill Book Company, Inc., 1947, pp. 794-795; and 2001 ARRL Handbook for Radio Amateurs, Chuck Hutchinson ed., American Radio Relay League, pp. 19.10-19.17 and 20.50-20.51.

SUMMARY OF THE INVENTION

It is an object of the present invention to provide an impedance matching device for a radio frequency transmission line.

The device comprises dielectric material, a microstripline conductor, a ground plane, and a movable dielectric plate. The microstripline conductor is disposed on one side of the dielectric material and the ground plane is disposed on the opposite side. The dielectric plate has a user-selectable shape, such as a wedge or triangle, a higher dielectric constant than the dielectric material, and is movable transversely and linearly along the micro-strip conductor. Affixed to the top surface of the movable dielectric plate is a conductive coating. The bottom surface of the movable dielectric plate engages a portion of the microstripline conductor, forming a lower impedance section on the transmission line. The movable dielectric plate is movable transversely to increase or decrease impedance, and linearly to change the phase.

In the preferred embodiment, the microstripline conductor is linear. In an alternate embodiment, the microstripline conductor forms an arc.

In another alternate embodiment, an impedance matching device comprises a microstripline conductor spaced a distance from a ground plane, and a movable dielectric plate. The movable dielectric plate engages the microstripline conductor and is located between the microstripline conductor and the ground plane.

The movable dielectric plate is movable transversely to increase or decrease impedance, and linearly to change the phase.

In another alternate embodiment, an impedance matching device comprises an open wire balanced transmission line and a movable dielectric plate. The movable dielectric plate is located between the balanced transmission line and is moveable vertically and horizontally to adjust intensity and phase, respectively.

BRIEF DESCRIPTIONS OF THE DRAWINGS

DETAILED DESCRIPTION OF THE INVENTION

Figure 1:
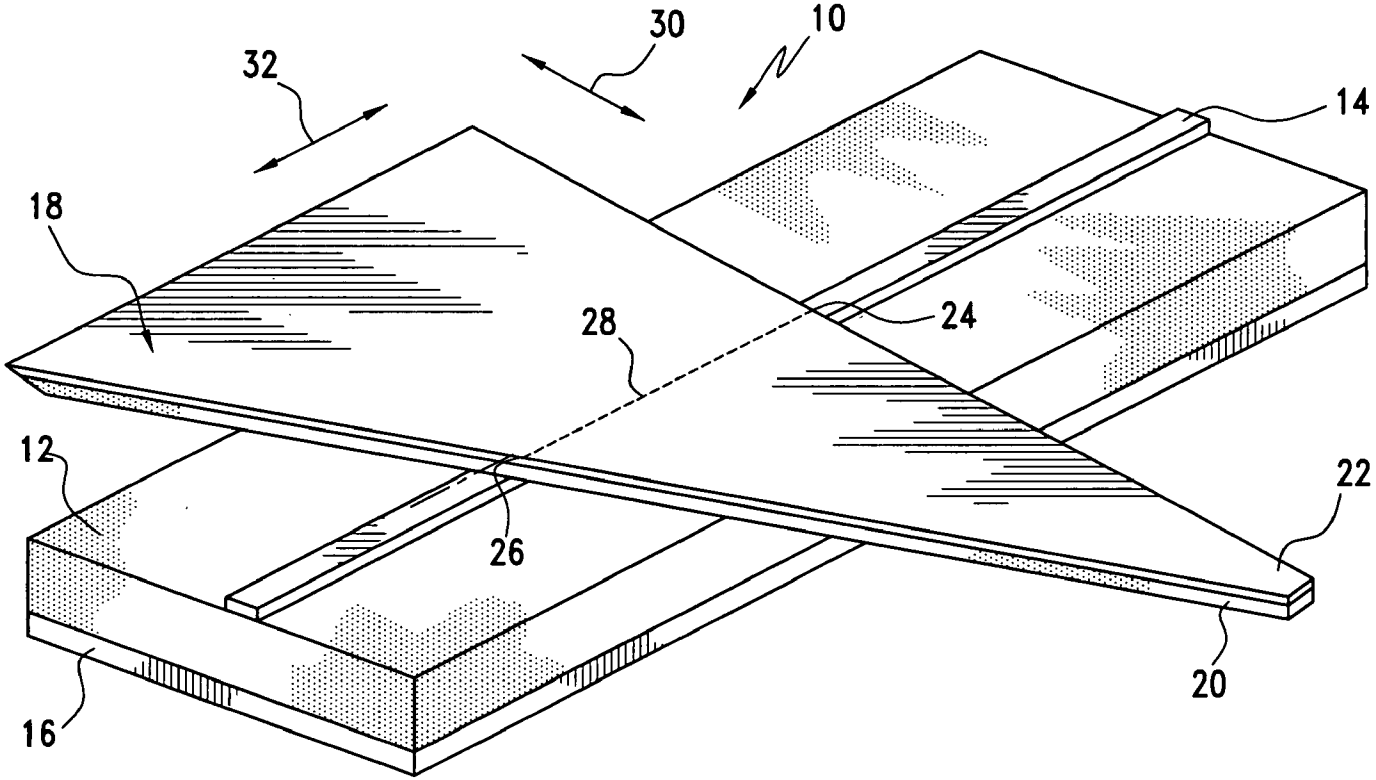
FIG. 1 is a perspective view of the impedance matching device of the present invention.

An impedance matching device 10 made in accordance with the present invention is disclosed in FIG. 1. The present invention is generally applicable to UHF and microwave frequencies, but is not limited to them with either the high or low frequencies. The impedance matching device 10 comprises a dielectric material 12, a microstripline conductor 14, a ground plane 16, and a movable dielectric plate 18.

Figures 2, 3:
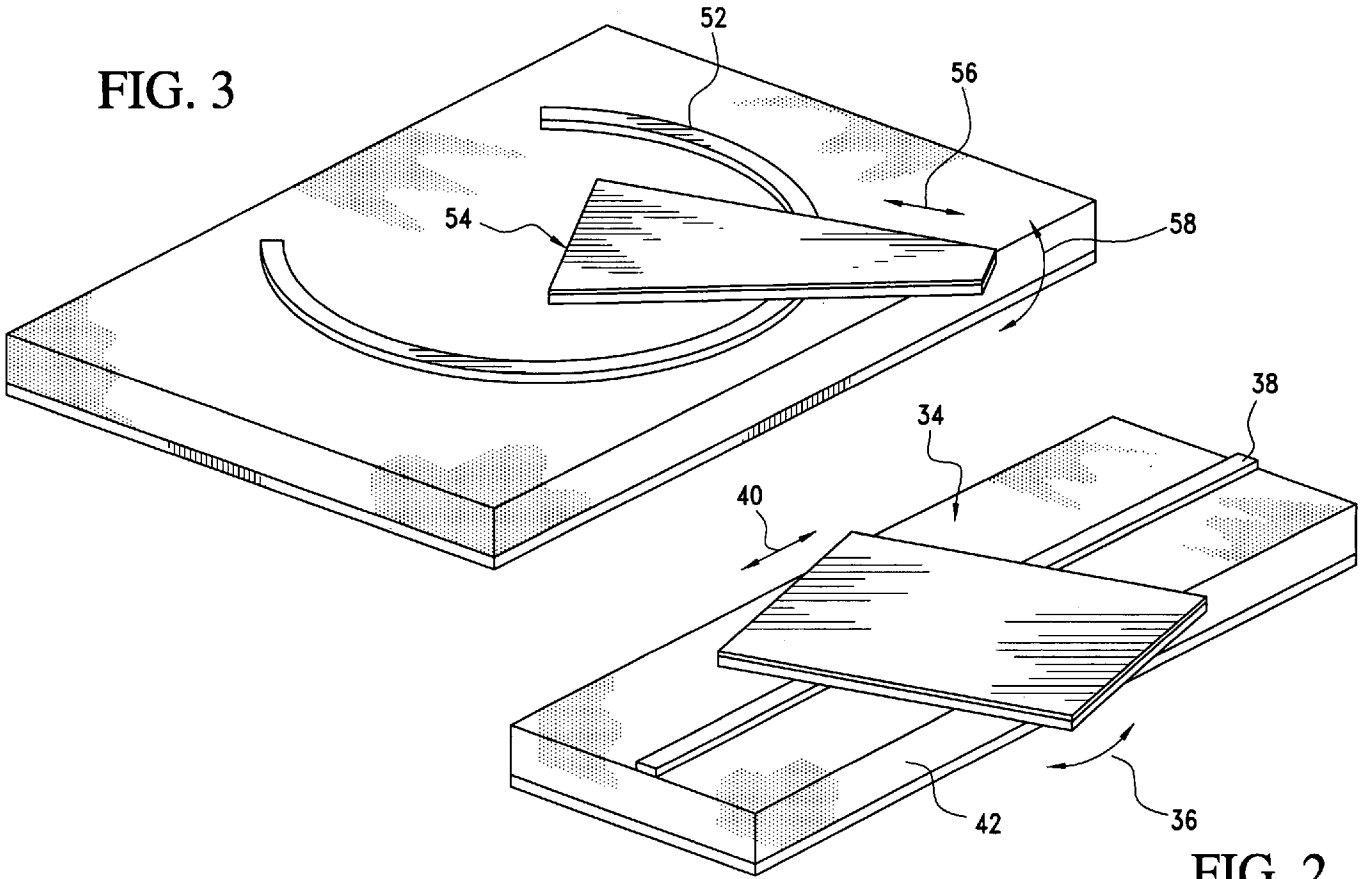
FIG. 2 is a perspective view of the embodiment of FIG. 1.
FIG. 3 is a perspective view of an alternate embodiment.

In the preferred embodiment, the dielectric material 12 is rectangular, although persons skilled in the art will recognize that the invention is not limited in this regard. The dielectric material has a first surface and a second surface. The second surface is opposite the first surface. A microstripline conductor 14 is disposed on the first surface of the dielectric material 12. In the preferred embodiment, the microstripline conductor 14 is linear. In an alternate embodiment, the microstripline conductor is arc shaped, as shown in FIG. 3. Referring again to FIG. 1, the microstripline conductor 14 has a nominal impedance of 50 ohms, and is about two electrical wavelengths long.

A ground plane 16 is disposed on the second surface of the dielectric material 12.

A movable dielectric plate 18 is supported by, and engages a portion of the microstripline conductor 14. The movable dielectric plate 18 has a user-selectable shape with non-parallel first and second outer edges. In the preferred embodiment, the movable dielectric plate 18 is wedge shaped. Alternatively, the movable dielectric plate 18 may be a triangle shape, a parallelogram shape, a semicircle shape, or any equivalent user-selectable shape.

The movable dielectric plate 18 has a top surface and a bottom surface. The bottom surface comprises a dielectric material 20 with a dielectric constant greater than the dielectric constant of the dielectric material 12. Affixed to the he top surface of the movable dielectric plate 18 is a conductive coating 22. The conductive coating 22 is held very near ground potential by the large capacitance (caused by the large surface area) to the ground plane 16.

The movable dielectric plate 18 has opposite non-parallel outer edges 24 and 26 that generally define a length 28 with the microstripline conductor 14. The length 28 changes as the movable dielectric plate 18 moves transversely of the microstripline conductor 14 in the direction generally indicated by the arrows 30 and 32. The length 28 forms a short section of much lower impedance on the microstripline conductor 14. The lower impedance section acts as a transmission line transformer, which may be adjusted to correct an impedance mismatch on the line.

It will be understood by persons skilled in the art that since there is no ohmic connection to the sliding parts, noise is reduced.

Referring to FIG. 2, as the movable dielectric plate 34 is moved in the direction transversely 36 to the microstripline conductor 38, the length of the lower impedance section is increased or decreased, thereby also changing the impedance of the section. Further, as the movable dielectric plate 34 is moved in the direction of the length of the microstripline conductor 40, the phase of the lower impedance section is varied.

The movable dielectric plate 34 is thinner or has a higher dielectric constant than the dielectric material 42, or both.

In an alternate embodiment of the present invention shown FIG. 3, the microstripline conductor 52 is in the form of an arc, instead of a straight line. The movable dielectric plate 54 is moved along the radius of the arc in the direction 56 to increase or decrease the length of the lower impedance section. The movable dielectric plate 54 is further rotated 58 about the center of the arc to vary the phase of the lower impedance section.

Figure 4:
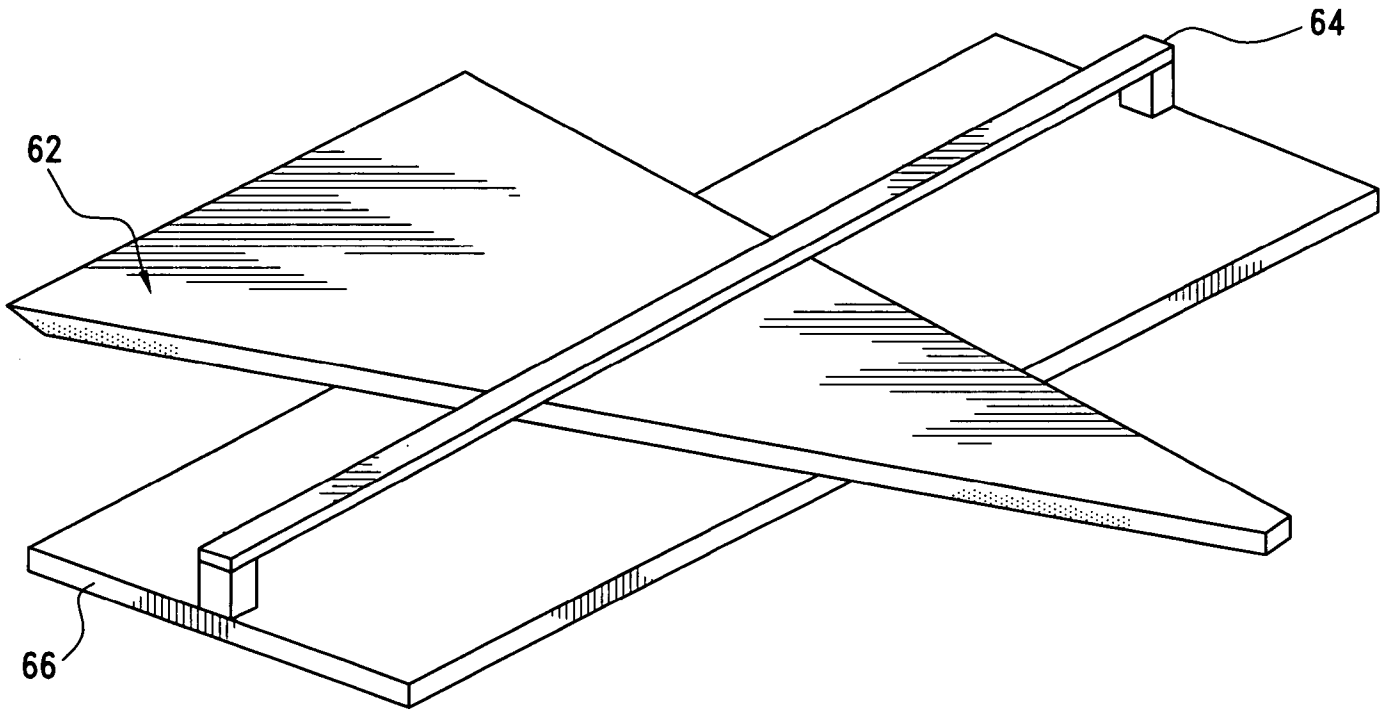
FIG. 4 is a perspective view of another alternate embodiment of the present invention.

In another embodiment of the present invention shown in FIG. 4, the movable dielectric plate 62 is located between the microstripline conductor 64 and the ground plane 66. The movable dielectric plate 62 does not have a conductive coating as in the movable dielectric plate 18 shown in FIG. 1. Referring again to FIG. 4, the movable dielectric plate 62 is spaced a distance from the ground plane 66 and slides linearly along the microstripline conductor 62 and transversely as described above.

Alternatively, the movable dielectric plate 62 extends from the microstripline conductor 62 to the ground plane. Those persons skilled in the art will recognize that the thickness of the movable dielectric plate 62 depends upon the dielectric constant used. Those persons skilled in the art will also recognize that the movable dielectric plate 62 may be metal loaded to increase the equivalent dielectric constant.

Figure 5:
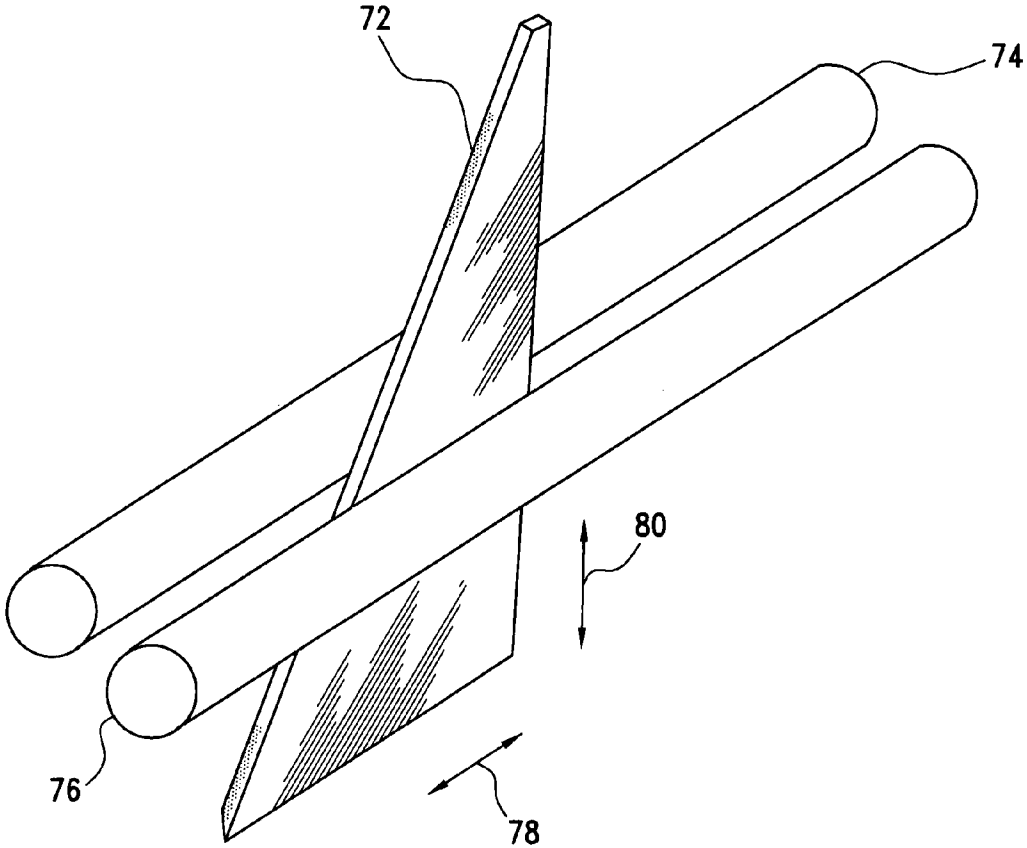
FIG. 5 is a perspective view of another alternate embodiment of the present invention for an open wire transmission line.

In another alternate embodiment shown in FIG. 5, the movable dielectric plate 72 is positioned vertically between the first conductor of an open wire balanced transmission line 74 and the second conductor of an open wire balanced transmission line 76. Persons skilled in the art will recognize that a balanced transmission line is one whose two conductors are electrically alike, and symmetrical with respect to ground and other nearby conductors.

As described above, the movable dielectric plate 72 has opposite non-parallel outer edges. The movable dielectric plate 72 has a user-selectable shape with non-parallel first and second outer edges, a first side surface disposed adjacent the first conductor of the open wire transmission line and a second side surface disposed adjacent to the second conductor of the open wire transmission line. The first side surface of the movable dielectric plate 72 engages a portion of the open wire transmission line forming a lower impedance section on the open wire transmission line.

Optionally, the movable dielectric plate 72 may have a conductor between two dielectric halves. The movable dielectric plate 72 slides linearly 78 along the open wire transmission line 72 and transversely 80 as described above.

Sliding the movable dielectric plate 72 linearly 78 changes the phase and sliding the movable dielectric plate 72 vertically 80 changes the impedance.

The effect from the movable dielectric plate 72 is greater the thicker the movable dielectric plate 72 is made.

While the preferred embodiments of the invention have been illustrated and described, it will be apparent to those of ordinary skill in the art that various changes and modifications may be made without deviating from the inventive concepts set forth above.

I claim:

1. An impedance matching device, comprising:

a) an open wire transmission line, said open wire transmission line having a first conductor and a second conductor; and b) a movable dielectric plate, said movable dieletric plate having a user-selectable shape with non-parallel first and second outer edges, a first side surface disposed adjacent said first conductor of said open wire transmission line and a second side surface disposed adjacent to said second conductor of said open wire transmission line, the first side surface of said movable dielectric plate engaging a portion of said open wire transmission line forming a lower impedance section on said open wire transmission line.

* * * * *